US005240047A

United States Patent [19]

Hedges

[11] Patent Number: 5,240,047

[45] Date of Patent: Aug. 31, 1993

[54] SYRINGE GUIDE AND BOTTLE HOLDER

[76] Inventor: Harry S. Hedges, 1612 Southern Ave., Kalamazoo, Mich. 49001

[21] Appl. No.: 879,244

[22] Filed: May 6, 1992

[51] Int. Cl.[5] ..... B65B 3/04

[52] U.S. Cl. ..... 141/21; 141/27; 206/365

[58] Field of Search ..... 141/18, 21, 25-27, 141/108, 329, 330; 206/219, 222, 365; 604/208, 407, 414, 416, 905

[56] References Cited

U.S. PATENT DOCUMENTS

| | | | |
|---|---|---|---|
| 1,838,825 | 12/1931 | Goldstein . | |
| 3,833,030 | 9/1974 | Waldbauer, Jr. et al. | 141/26 |
| 3,844,318 | 10/1974 | Raia et al. | 141/27 |
| 3,853,158 | 12/1974 | Whitty | 141/27 |
| 3,874,380 | 4/1975 | Baum | 141/27 |
| 3,875,979 | 4/1975 | Hults | 141/27 |
| 4,287,988 | 9/1981 | House | 206/365 |
| 4,475,915 | 10/1984 | Sloane | 141/27 |
| 4,778,454 | 10/1988 | LaDow | 141/27 |
| 4,986,322 | 1/1991 | Chibret et al. | 141/25 |

FOREIGN PATENT DOCUMENTS

| | | | |
|---|---|---|---|
| 9100215 | 1/1991 | PCT Int'l Appl. | 141/21 |

*Primary Examiner*—Jimmy G. Foster
*Attorney, Agent, or Firm*—Harry Williams

[57] ABSTRACT

A unitary one-piece needle-guide and bottle-holder device in which one portion of the device is adapted to securely yet removably receive a portion of a bottle or vial such that a central area of the needle-penetratable cap on the bottle is exposed to a needle-guide channel which in turn communicates with a needle guide for guiding a syringe to an abutment therein which allows constant or same-depth penetration of the needle into a vial every time the guide device is used and without risk or harm to the user.

5 Claims, 1 Drawing Sheet

FIG. 1
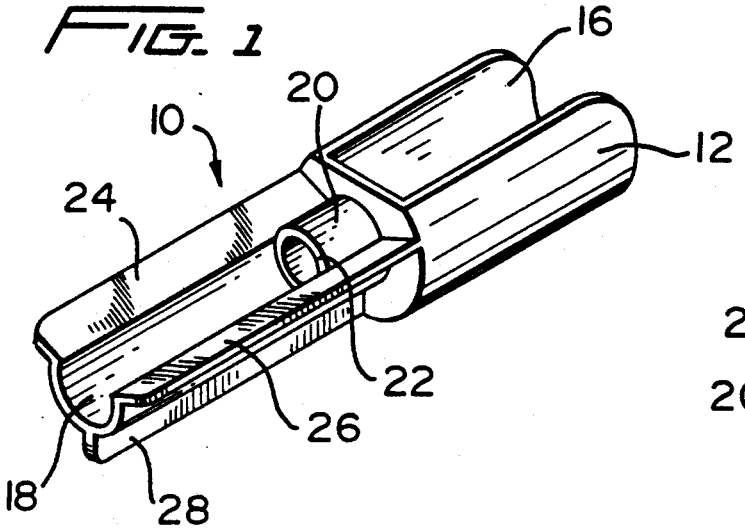
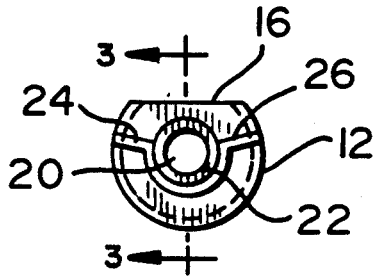
FIG. 2
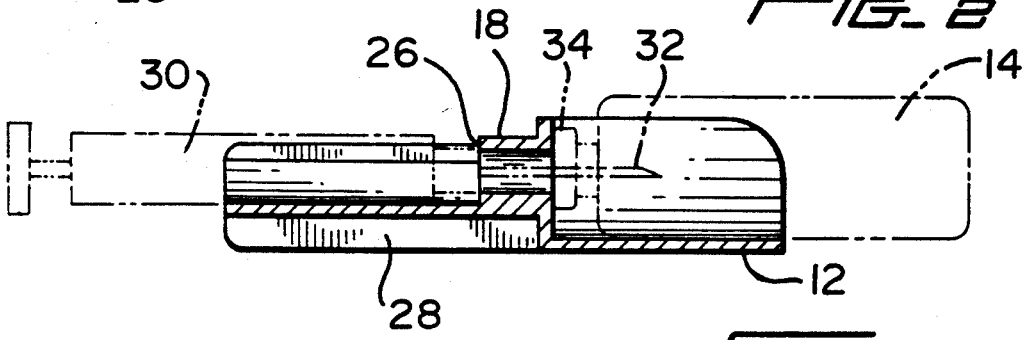
FIG. 3
FIG. 4
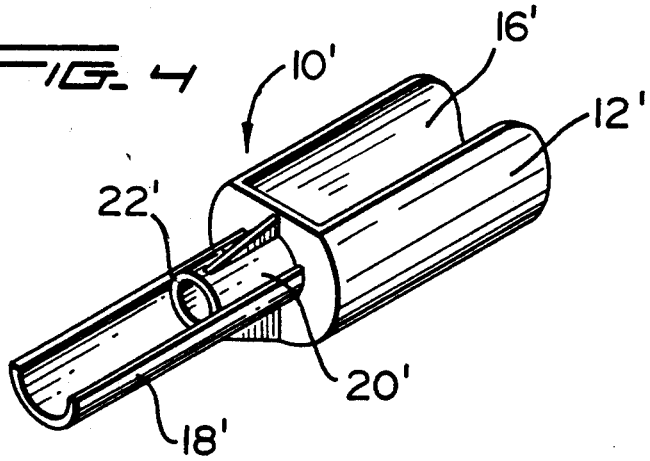
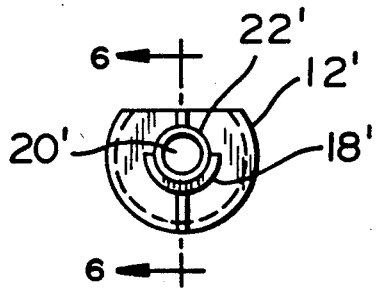
FIG. 5
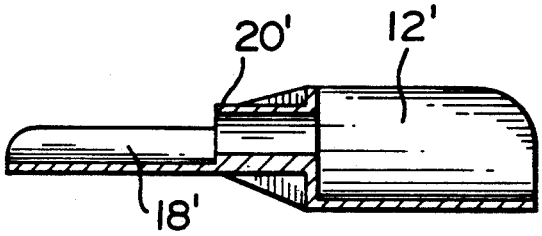
FIG. 6

SYRINGE GUIDE AND BOTTLE HOLDER

BACKGROUND OF THE INVENTION

This invention relates to the use of syringes in the field of medicine and particularly to an apparatus for facilitating the loading of a syringe from a bottle or vial containing a liquid medication.

In the past it has been customary to manually apply a syringe to a source container of liquid medication, such as insulin, vaccine or some such other medication by "eye-balling" the point of the needle of the syringe to the cap of the container of medication, puncturing the cap with the needle, then removing the fluid from the bottle in the conventional manner. Such methods of loading a syringe, however, are fraught with risk to the user of the syringe, since it is quite possible for the user in his attempt to mate the needle with the bottle cap to miss the bottle cap or deflect the needle off the cap and thus cause injury not only to the user but to anyone in the immediate vicinity. With the proliferation of virus-infected blood, it becomes especially important not to risk the accidental drawing of blood from either patient, doctor, or paramedic when working with syringes in a medical environment. A need therefore exists for a safe an efficient method for loading a syringe without risking harm to those in the medical environment.

OBJECTS AND SUMMARY OF THE INVENTION

It is a primary purpose and principle object of the present invention to address the aforementioned need and provide a simple and safe apparatus for loading a syringe from a bottle, vial or vessel containing a fluid medication without risking harm to the user of the syringe or to anyone in the immediate vicinity of the syringe.

A main feature of the present invention is the provision of a needle guide and bottle holder device which will insure that the needle of a syringe can be inserted into a bottle in a safe and easy manner in the same way every time for maximum fluid extraction without risk of puncture to the user.

Another feature of the present invention is the unitary, one-piece structure of the guide device that allows it to be carried separately in pouch or pocket for quick easy use. to form a permanent part.

Still another feature of the invention ia to have the device form a permanent part of the bottle or vial, if so desired, so that the vial/needle guide device can be stored or refrigerated with the bottle or vial.

Yet another feature of the invention is the provision of a level base portion to support the guide device on a flat surface in a fixed position during a fluid-extraction operation.

Still yet another feature of the invention allows the bottle-holding portion of the guide device to firmly grip the vial or bottle in a friction-fit manner so that both the vial and guide device can be manually held by the user as a single and workable unit.

Yet another feature of the invention is to allow the bottle-holding portion of the device to afford visibility of the contents within the vial throughout its length.

According to one embodiment of the present invention there is provided a unitary one-piece needle guide and bottle holder in which one portion of the guide is adapted to securely yet removably receive a portion of a bottle or vial such that a central area of the needle-penetratable cap on the bottle is exposed to a needle-guide channel which in turn communicates with a syringe needle guide, namely, a cradle for receiving the needle portion of a conventional syringe, so that the syringe can be guided to an abutment therein which allows for constant or same-depth penetration of the needle into a vial every time the guide device is used.

The invention will be better understood as well as further objects and advantages thereof become more apparent from the ensuing detailed description taken in conjunction with the drawings.

BRIEF DESCRIPTION OF THE DRAWINGS

FIG. 1 is a schematic perspective view of the needle guide and bottle holder device according to the invention;

FIG. 2 is a schematic end view of the device shown in FIG. 1;

FIG. 3 is a schematic cross-sectional view of the device taken along the lines 3—3 in FIG. 2;

FIG. 4 is a schematic perspective view of a further embodiment of the invention;

FIG. 5 is a schematic end view of the device shown in FIG. 4; and

FIG. 6 is a schematic cross-sectional taken along the lines 6—6 in FIG. 5.

DETAILED DESCRIPTION

Referring now to FIG. 1, there is shown according to one embodiment of the invention a one-piece needle-guide and bottle-holder device 10, formed of a suitable plastic material, either opaque or transparent but preferably transparent, and having some degree of elasticity. The device 10 is shown to have a bottle-holding portion 12 of a generally cylindrical shape conforming to the cylindrical shape of a conventional vial or bottle 14 (see FIG. 3). The elasticity of the plastic allows the relatively thin walls of the bottle-holder portion 12 to be slightly expanded when fitted onto the vial 14 so that a good friction-fit is assured. The top section of the bottle-holder portion 12 is exposed to provide a slot 16 that runs the length thereof so that the contents of the bottle 14 can be viewed directly without interference from the guide device (see also FIG. 2).

Opposite the bottle-holder portion 12 and integral therewith is the syringe-guide portion 18 which is generally of a smaller cylindrical shape than the bottle-holder portion. A connecting channel member 20 is seen to connect the two aforementioned needle-guide and bottle-holder portions of the device 10, so that when a syringe 30 is placed in the needle guide portion the needle 32 can extend through the channel, puncturing the needle penetratable cap 34 on the vial or vial 14 and thus pass into the interior of the bottle 14, as shown in FIG. 3. The front face 22 of the tunnel member 20 acts as an abutment surface for the syringe 30; that is, once the syringe is in place in its guide 18, it can be pushed up against the abutment surface 22 of the tunnel member 20 to thereby limit the depth of penetration of the needle into the vial 14. The syringe-guide portion 18 is also seen to have three rib members 24, 26 and 28 . The bottom-most rib member 28 acts as a support for the device when it is placed, as shown, on a flat surface, that is, a surface underlying the rib member 28 and the vial-holder portion 12. The other two rib members 24, 26 act as guide members for facilitating reception of the syringe into the cylindrical guide 18.

FIGS. 4–6 show a further embodiment of the invention where similar elements of the device as shown in FIGS. 1–3 are ascribed with the same but primed numerals. Thus, the device 10′ is seen to have a bottle-holder portion 12′, a viewing slot 16′, a needle-guide portion 18′, a connecting tunnel member 20′ therebetween and an abutment surface 22′. In this embodiment, however, the flange or rib members shown in FIGS. 1–3 are dispensed with and the viewing slot is opened, flush with the tunnel 20′ for the sake of lightness and economy, so that the device 10′ is less bulky and therefor easier to store or package and is less costly to produce. For maximum safety, rib members 24, 26 should be retained to provide maximum protection to the hand the user employs to hold the device during loading of the syringe 30 into the syringe guide 18. Rib members 24, 26 also reduce warping during the molding process.

The operation of the device according to the invention, then, is quite simple. The user merely inserts the bottle or vial 14 into the open end of the vial-holder portion 14 until it is firmly seated, that is, the vail's "bull's eye" on the cap 34 is flush up against the front surface of the vial-holder and communicating with the tunnel member 20, as shown in FIG. 3. The user then removes the conventional needle cover from the syringe 30, pulls out the plunger to take in the required amount of air, lays the syringe body in the guide 18, as shown, making sure, too, that the marks on the syringe are visible and the needle tip clears the abutment stop 22 and is poised to enter the tunnel 20. The syringe is then pushed along the guide 18 until it stops (that portion of the syringe which connects to the needle will then abut against the abutment surface 22). The entire device, including the syringe and vial, is then tipped down (the bottle pointing up) and the syringe plunger is then pressed in until it has bottomed, thus forcing the required amount of air into the vial. The user then reverses the position of the integrated unit (syringe/holder/vial) so that the vial is now pointing down and pulls the plunger back out to fill the syringe with the required number of cc's (units of measurement). The user then pulls the syringe body straight out of the device by sliding it along the guide 18 away from the vial so that the device (holder/vial) can be put into a safe place before the syringe is used as intended. It should be noted that the syringe guide portion 18 of the device 10 can be manufactured to different sized curvatures to accommodate different sized syringes. Also, a larger-sized syringe guide can accommodate some smaller-sized syringes so long as the needle in both cases clears the stopping surface 22 and is allowed to enter the tunnel member 20. For this reason the distance between the surface of the syringe guide 18 and the inner peripheral surface of the tunnel member 20 need only be great enough to allow needle 32 clearance and yet provide a stopping surface 2. The shape and size of the tunnel 22 as pictured in the drawings is the preferred form of the invention to assure maximum penetration of the vial and therefore maximum extraction. However, the length of the tunnel member is not critical in order to reduce injury to the user, that is, when the use of the syringe and vial-holder with its channel and tunnel members, according to the invention, is compared with the use of a syringe and vial alone.

The foregoing relates to a preferred exemplary embodiment of the present invention, it being understood that other embodiments and variants thereof are possible within the scope of the invention, the latter being defined by the appended claims.

What is claimed and desired to be secured by Letters Patent of the United States is:

1. A one-piece syringe guide and vial-holder device for use coincidentally with a vial and a syringe comprising, a channel having a free edge at one end thereof and an opening extending the length thereof for receiving and viewing said syringe through said opening.

a cavity having an opening extending the length thereof for removably holding a portion of said vial, including a needle-penetratable cap on said vial, and for viewing the contents of said vial through said opening, a tunnel member communicating between said channel and said cavity, a stop member disposed in said channel, and said channel having an interior surface that is substantially constant in cross-section from said free edge to said stop member, whereby said syringe is caused to abut said stop member when said syringe is slid along said channel, and the needle of said syringe is caused to enter said tunnel member, penetrate said cap and enter said vial.

2. A syringe guide and vial-holder device according to claim 1, wherein two opposing flange members extend outwardly from said opening in said channel for facilitating the placement of said syringe in said channel.

3. A one-piece syringe guide and vial-holder device for use coincidentally with a vial and a syringe comprising, a channel having a free edge at one end thereof and an opening extending the length thereof for receiving said syringe through said opening, a cavity for removably holding a portion of said vial, including a needle-penetratable cap on said vial, a tunnel member communicating between said channel and said cavity, a stop member disposed in said channel, and said channel having an interior surface that is substantially constant in cross-section from said free edge to said stop member, whereby said syringe is caused to abut said stop member when said syringe is slid along said channel, and the needle of said syringe is caused to enter said tunnel member, penetrate said cap and enter said vial.

4. A syringe guide and vial-holder device according to claim 3, wherein said cavity comprises an elastic material to facilitate removal of said vial from said cavity.

5. A syringe and vial-holder device according to claim 3, wherein one end of said tunnel member comprises said stop member for said syringe.

* * * * *